United States Patent [19]

Curtis et al.

[11] Patent Number: 4,932,909

[45] Date of Patent: Jun. 12, 1990

[54] COWL LOCKING MECHANISM

[75] Inventors: Mark D. Curtis, Oshkosh; David Heidel, Green Lake, both of Wis.

[73] Assignee: Brunswick Corporation, Skokie, Ill.

[21] Appl. No.: 360,990

[22] Filed: Jun. 2, 1989

Related U.S. Application Data

[63] Continuation-in-part of Ser. No. 213,542, Jun. 30, 1988, Pat. No. 4,871,333.

[51] Int. Cl.[5] ..... B63H 21/26

[52] U.S. Cl. ..... 440/77; 123/195 P

[58] Field of Search ..... 440/76, 77; 123/195 P

[56] References Cited

U.S. PATENT DOCUMENTS 3,358,668 12/1967 Post et al. ..... 440/77 X 4,871,333 10/1989 Curtis et al. ..... 440/77

*Primary Examiner*—Sherman D. Basinger

*Attorney, Agent, or Firm*—Andrus, Sceales, Starke & Sawall

[57] ABSTRACT

A locking mechanism for a two piece cowling for a marine engine includes a latch that is pivotally mounted on the lower cowling piece and includes a handle disposed within a recess on the exterior of the lower cowling so that when the latch is in its locked position, the handle is contained by the recess and is flush with the cowling so as not to detract from the styling of the cowling and the longitudinal axis of the elongated handle is disposed parallel to forces acting on the lower unit of the engine so as to resist forces tending to move the handle to its release position.

3 Claims, 2 Drawing Sheets

COWL LOCKING MECHANISM

BACKGROUND OF THE INVENTION

This application is a continuation in part of application Ser. No. 07/213,542 filed on June 30, 1988, now U.S. Pat. No. 4,871,333.

The inner workings of a marine outboard engine are typically concealed by the use of a cowling that is secured in place through a locking or latching mechanism. Each outboard manufacturer has adopted its own shape or style for its cowling so that its product can easily be identified from a distance. The styling of the cowling is actually a factor considered by the customer when determining which type of outboard to purchase.

In the past, a "clam shell" design was utilized for the cowling and the latching mechanism for this type of cowling was concealed by a front shield. As the styling evolved to a "bucket style" cowl, the latches could no longer be concealed by a front shield and it was necessary to design a locking mechanism that would not protrude from the cowling and detract from the classic styling of the cowling.

It is also desirable to have a locking mechanism that would resist the sudden forces experienced by the lower unit of a marine engine and remain in a locked position even when the marine engine is suddenly and forcefully rotated about its pivotal mounting as would happen upon striking an underwater obstacle.

SUMMARY OF THE INVENTION

A locking mechanism for a two piece cowling for a marine engine includes a latch that is pivotally mounted about a vertical axis on the lower cowling piece and which is movable between a locking position and a release position. The latch includes a handle portion which is disposed within a recess on the exterior of the cowling so that when the latch is in the locking position, the handle is flush with the cowling piece and blends with the styling of the cowling.

In accordance with another aspect of the invention, a coupling piece is adjusted within the upper cowling piece and is engageable by the clamp portion of the latch when the latch is moved to its locking position.

In accordance with yet another aspect of the invention, the elongated handle is disposed with its longitudinal axis parallel to the direction of the force acting on the lower portion of the engine and tending to rotate the engine about its mounting.

In accordance with still another aspect of the invention, the elongated handle extends forwardly from the vertical axis of the pivoting latch.

The present invention thus provides a locking mechanism for a cowl that does not protrude from cowling and thus detract from the shape and/or styling of the cowling.

The present invention also provides a locking mechanism that will remain in its locked position during sudden and rapid rotational movement of the engine about its pivotol mounting.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
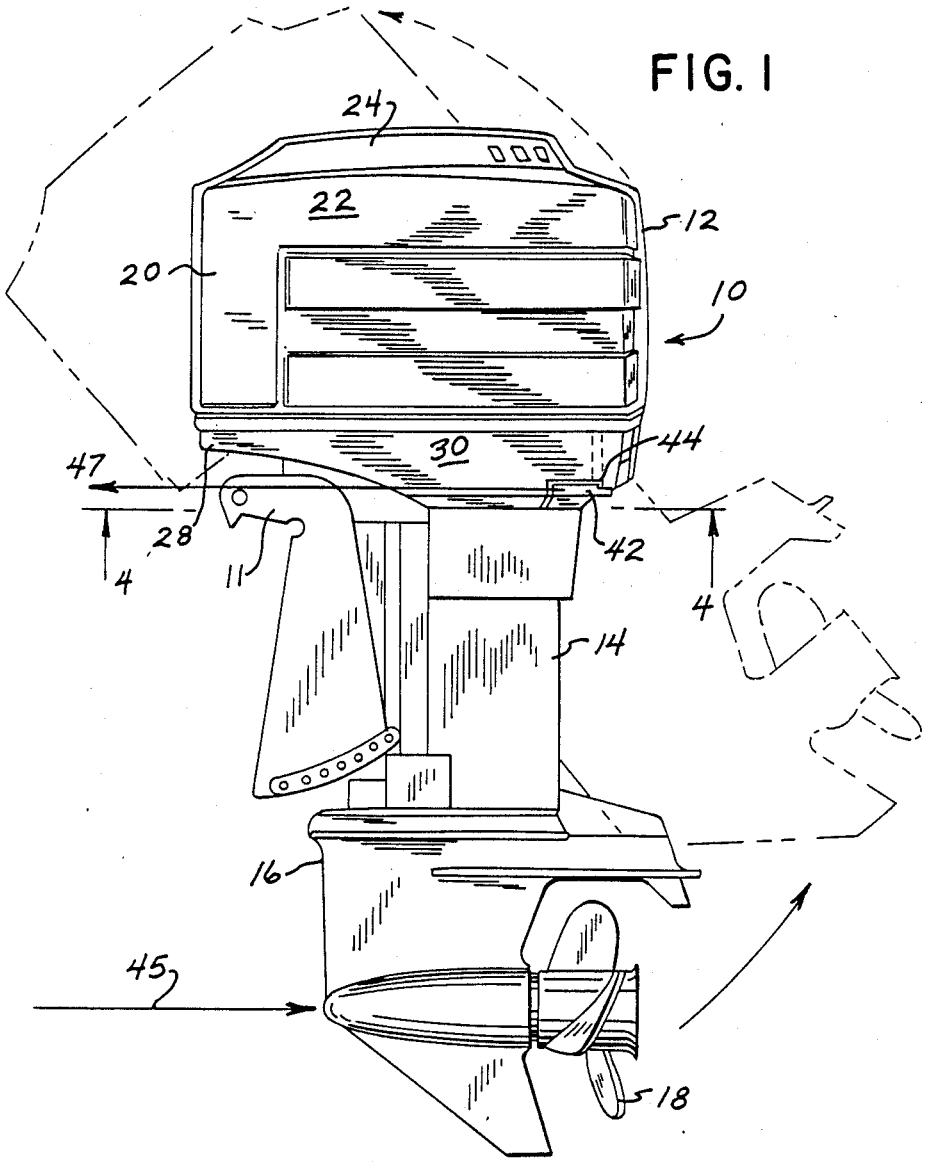
FIG. 1 is a side view of a marine outboard engine utilizing the cowl locking mechanism of the present invention and illustrating a force on the lower portion of the engine and resulting pivotal movement in phantom.
Figure 3:
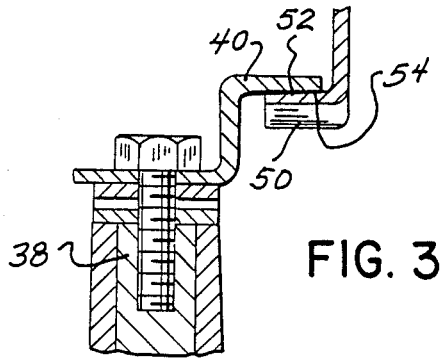
FIG. 3 is a sectional view along line 3—3 of FIG. 2.
Figure 2:
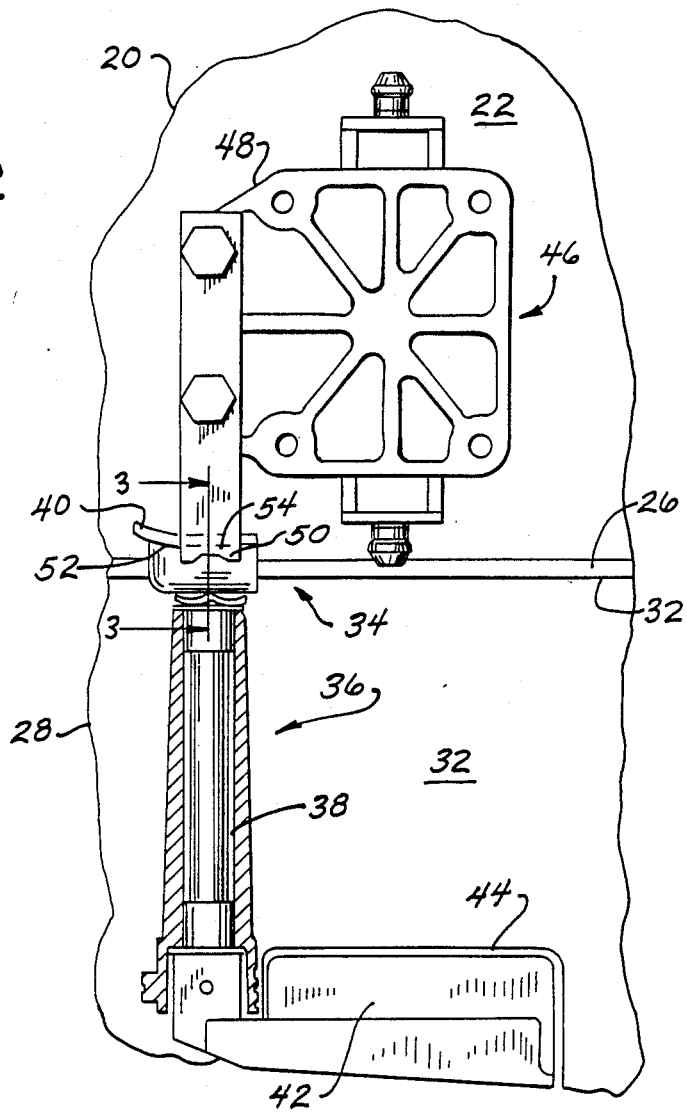
FIG. 2 is an enlarged side cross sectional view of the locking mechanism of FIG. 1.

As shown in FIG. 1, a marine outboard engine 10 is pivotally mounted on the transom of a boat (not shown) by transom bracket 11 and includes a power head concealed by a cowling 12, a drive shaft housing 14 and a lower unit 16 including a propeller 18.

Cowling 12 includes an upper piece 20 having a plurality of sidewalls 12 joined by a top piece 24 so as to define a downwardly facing opening 26 and a lower piece 28 having a plurality of sidewalls 30 which define an upwardly facing opening 32.

Upper piece 20 and lower piece 28 are secured to each other by locking mechanism 34. Locking mechanism 34 includes a latch 36 that is pivotally mounted on the interior of sidewall 32 of lower cowling piece 28. Latch 36 includes a vertical post 38 which pivots about its longitudinal axis and on which is mounted a horizontally extending leg 40. The pivoting of post 38 is accomplished by elongated handle 42 which is disposed within a recess 44 on the side of the rear portion of lower cowling piece 28. Thus, when latch 36 is in its locking position, as shown in all of the figures, handle 42 will be contained within recess 44 and will not protrude from the cowling so as to detract from the smooth styling of the cowling.

Figure 4:
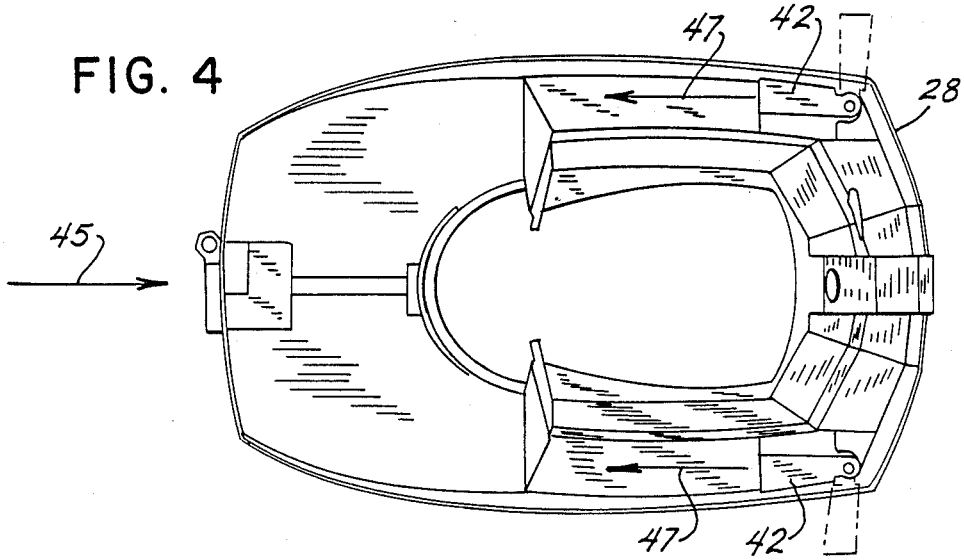
FIG. 4 is a sectional view along line 4—4 of FIG. 1.

As shown in FIG. 1 and FIG. 4, an underwater obstacle may cause a sudden and unexpected force 45 on lower unit 16. Force 45 causes engine 10 to pivot about bracket 11 to the position shown in phantom in FIG. 1. Elongated handle 42 is disposed in its closed position with its longitudinal axis substantially parallel to force 45, so that inertial force 47 of handle 42 at rest will oppose and resist a force caused by force 45 and tending to move handle 42 from its locking position to its release position shown in phantom in FIG. 4.

Latch 36 further includes a coupling piece 46 having a bracket 48 mounted on sidewall 22 of upper cowling piece 20. An engaging arm 50 extends from bracket 48 into the space defined by sidewalls 22. Leg 40 overlaps engaging arm 50 and is provided with a curved surface 52 which engages a curved surface 54 on engaging arm 50 when latch 36 is pivoted to its locking position.

In use, when it is necessary to obtain access to the power head, handle 42 is moved to a release position where it protrudes from cowling piece 28. With handle 42 in this position post 38 is rotated to a position where leg 40 is disengaged from arm 50. Upper cowling piece 20 may then be lifted off lower cowling piece 28.

While only a single latching mechanism has been shown and described it should be understood that an identical latching mechanism is located on the other side of the cowling.

The present invention thus provides a locking mechanism which when in its locked position is flush with the cowling so as not to detract from the styling or unique shape of the cowling.

It is recognized that various alternatives and modifications are possible in the scope of the appended claims.

Various modes of carrying out the invention are contemplated as being within the scope of the following claims particularly pointing out and distinctly claiming the subject matter which is regarded as the invention.

We claim:

1. A locking mechanism for securing an upper cowling piece to a lower cowling piece of a marine engine, where the marine engine is mounted for pivotal movement about a horizontal axis on the stern of a boat and where the lower portion of the marine engine may be subject to external forces acting in a rearward direction and causing sudden rotational movement of the engine about the horizontal axis, said locking mechanism comprising:

a latch mounted on one of the cowling pieces and movable about a vertical axis between a locking position and a release position, a coupling piece disposed within the other of the cowling pieces and engageable by said latch when said latch is moved to its locking position and an elongated handle operably connected to said latch for moving said latch between said locking and release positions, said handle being disposed on the exterior of one of the cowling pieces and having its longitudinal axis substantially parallel to the direction of the force acting on the lower portion of the marine engine when said handle is in said locking position, so that the inertial force of said handle at rest will resist a force caused by said force on said lower portion and tending to move said handle to said latch release position, said handle being disposed within a recess on the exterior of a side of the cowling piece such that it is flush with the side of the cowling piece.

2. The locking mechanism defined in claim 1 wherein said elongated handle extends forwardly from said vertical axis.

3. The locking mechanism defined in claim 1 wherein said recess is disposed on a rearward portion of said cowling piece.

* * * * *